US007357663B2

(12) United States Patent
Wei et al.

(10) Patent No.: US 7,357,663 B2
(45) Date of Patent: Apr. 15, 2008

(54) ELECTRICAL CONNECTOR WITH LATCHING MEMBER

(75) Inventors: Ti-Li Wei, Tu-Cheng (TW); Guo-Jiun Shiu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/708,862

(22) Filed: Feb. 21, 2007

(65) Prior Publication Data

US 2007/0202737 A1 Aug. 30, 2007

(30) Foreign Application Priority Data

Feb. 27, 2006 (TW) ..... 95203254 U

(51) Int. Cl.
*H01R 12/24* (2006.01)

(52) U.S. Cl. ..... 439/495; 439/260; 439/329; 439/325

(58) Field of Classification Search ..... 439/495, 439/493, 325, 329, 492, 496
See application file for complete search history.

(56) References Cited

U.S. PATENT DOCUMENTS 6,089,905 A * 7/2000 Shimmyo et al. ..... 439/495
6,280,240 B1 8/2001 Chang
6,341,988 B1 * 1/2002 Zhu et al. ..... 439/630

FOREIGN PATENT DOCUMENTS

CN 2445464 8/2001

* cited by examiner

*Primary Examiner*—Renee Luebke
*Assistant Examiner*—Harshad C Patel
(74) *Attorney, Agent, or Firm*—Wei Te Chung

(57) ABSTRACT

An electrical connector comprises an insulative housing (1) defining an receiving cavity (10); a plurality of conductive terminals (2) disposed in the housing and each terminal having a contact beam (21) with a contact portion exposed to the receiving cavity; a pressing member (3) having a pair of latching arms (31) and associated with the housing by the latching arms, the pressing member movable between an opened position and a closed position; and a pair of latching members (4) assembled on the housing and each latching member comprising a resilient arm (40) having a latching portion (401). When the pressing member arrives at the closed position, the latching arms urge corresponding resilient arms to move toward the receiving cavity so as to achieve an engagement between the latching portions and the sheet-like connection member.

11 Claims, 7 Drawing Sheets

ELECTRICAL CONNECTOR WITH LATCHING MEMBER

BACKGROUND OF THE INVENTION

1. Field of the Invention

The present invention relates to an electrical connector, and more particularly to an electrical connector for a sheet-like connection member such as a flexible printed circuit or a flexible flat cable.

2. Description of Related Art

U.S. Pat. No. 6,280,240 discloses a conventional connector adapted for connecting a flexible printed circuit (FPC). The electrical connector includes a housing having an insertion cavity for receiving the FPC, a plurality of conductive terminals disposed in the housing side by side along a longitudinal direction and a pressing member which is movable between an opened position and a closed position along an insertion direction of the FPC. A pair of board locks are provided on longwise ends of the housing. Each board lock has a latching portion for blocking the pressing member breaking away from the housing, a solder portion for soldering the connector to a printed circuit board and a retention portion for frictionally securing the board lock onto the housing. The pressing member has a tongue plate and a pair of latching arms extending along the tongue plate for latching with the latching portions of the board locks. When the FPC is assembled into the insertion cavity, the pressing member is shifted from opened position to the closed position. Meanwhile, the tongue plate urges the FPC to electrically connect with contact portions of the conductive terminals. That is, the FPC is held in the insertion cavity by the tongue plate and contact portions. However, this configuration of the electrical connector makes the sheet-like connection member easily departing away its proper position when the sheet-like connection member suffers from some unexpectable external forces during transporting or using or other applications.

Therefore, a new connector is desired to overcome the disadvantage of the prior art connector.

SUMMARY OF THE INVENTION

An object of the present invention is to provide an electrical connector with a latching member which can stably retain a sheet-like connection member therein.

In order to achieve the above-mentioned object, an electrical connector for a sheet-like connection member in accordance with the present invention is provided. The electrical connector comprises an insulative housing defining an receiving cavity; a plurality of conductive terminals disposed in the housing and each terminal having a contact beam with a contact portion exposed to the receiving cavity; a pressing member having a pair of latching arms formed its lengthwise ends thereof, the pressing member associated with the housing by the latching arms and movable between an opened position where the sheet-like connection is permitted to enter in the receiving cavity and a closed position where the pressing member urges the sheet-like connection member to electrically connect with the contact portions of the terminals; and a pair of latching members assembled on the housing and each latching member comprising a resilient arm having a latching portion. When the pressing member is moved to the closed position, the latching arms urge corresponding resilient arms to move toward the receiving cavity so as to achieve an electrical stable engagement between the latching portions and the sheet-like connection member.

Other objects, advantages and novel features of the present invention will become more apparent from the following detailed description of the present embodiment when taken in conjunction with the accompanying drawings.

DETAILED DESCRIPTION OF THE INVENTION

Figure 1:
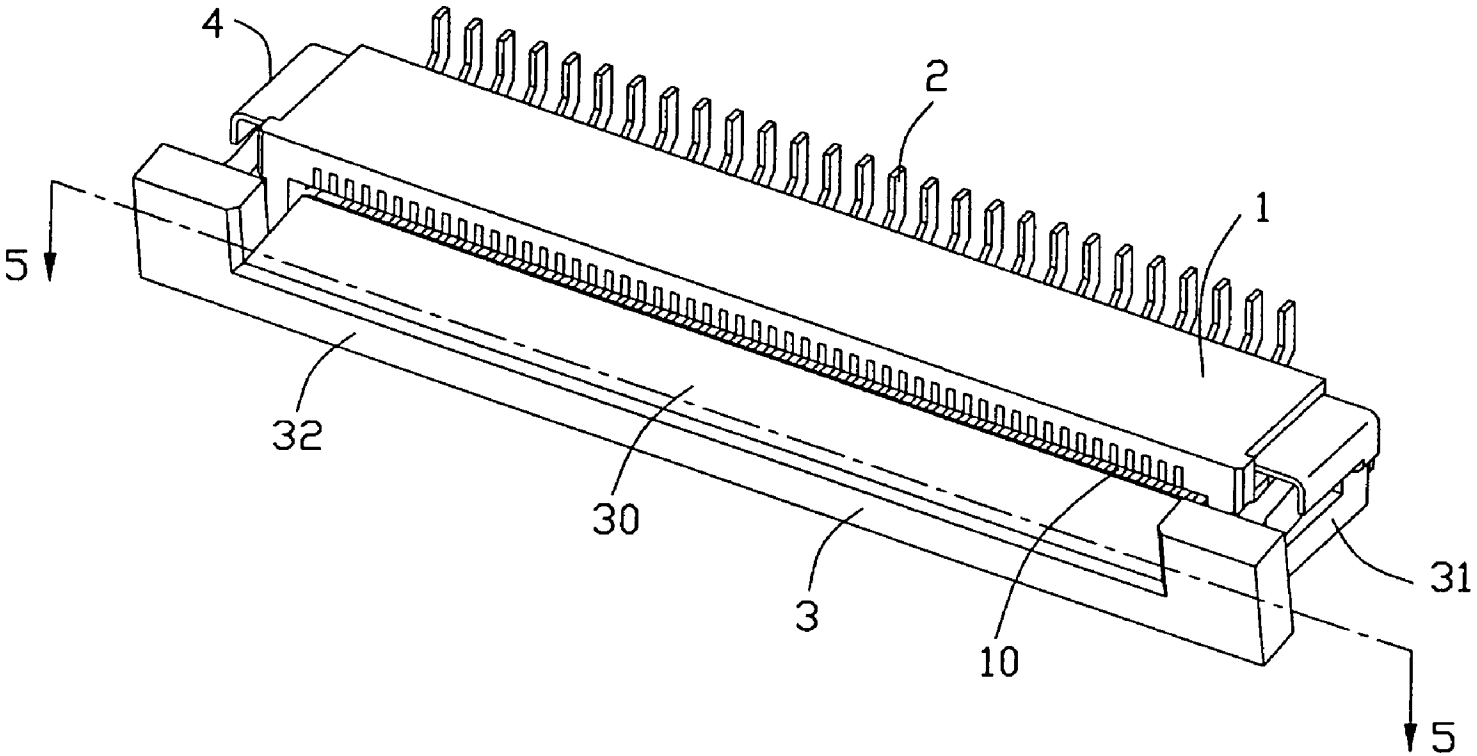
FIG. 1 is an assembled perspective view of an electrical connector in accordance with the present invention, wherein a pressing member is in an opened position.

Reference will now be made to the drawing figures to describe the preferred embodiment of the present invention in detail.

Figure 7:
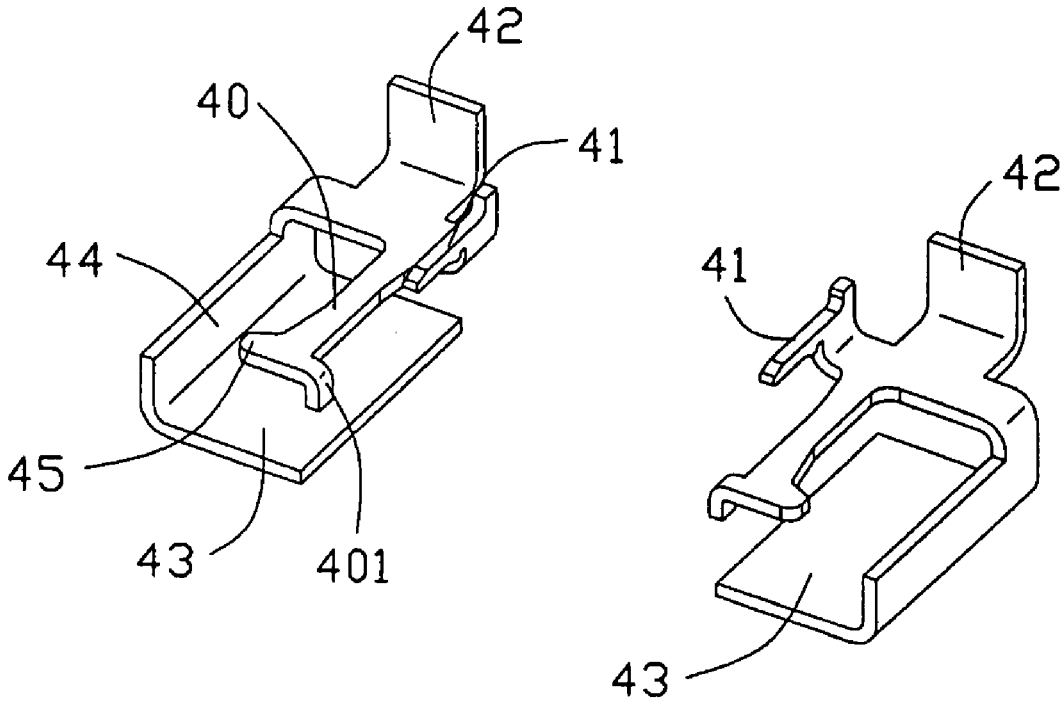
FIG. 7 is an enlarged view of latching members of the electrical connector.

Referring to FIGS. 1 and 7, an electrical connector for connecting a sheet-like connection member (not shown) in accordance with the present invention is provided. The electrical connector comprises an insulative housing 1, a plurality of conductive terminals 2 disposed in the housing 1, a pressing member 3 and a pair of latching members 4.

Figure 3:
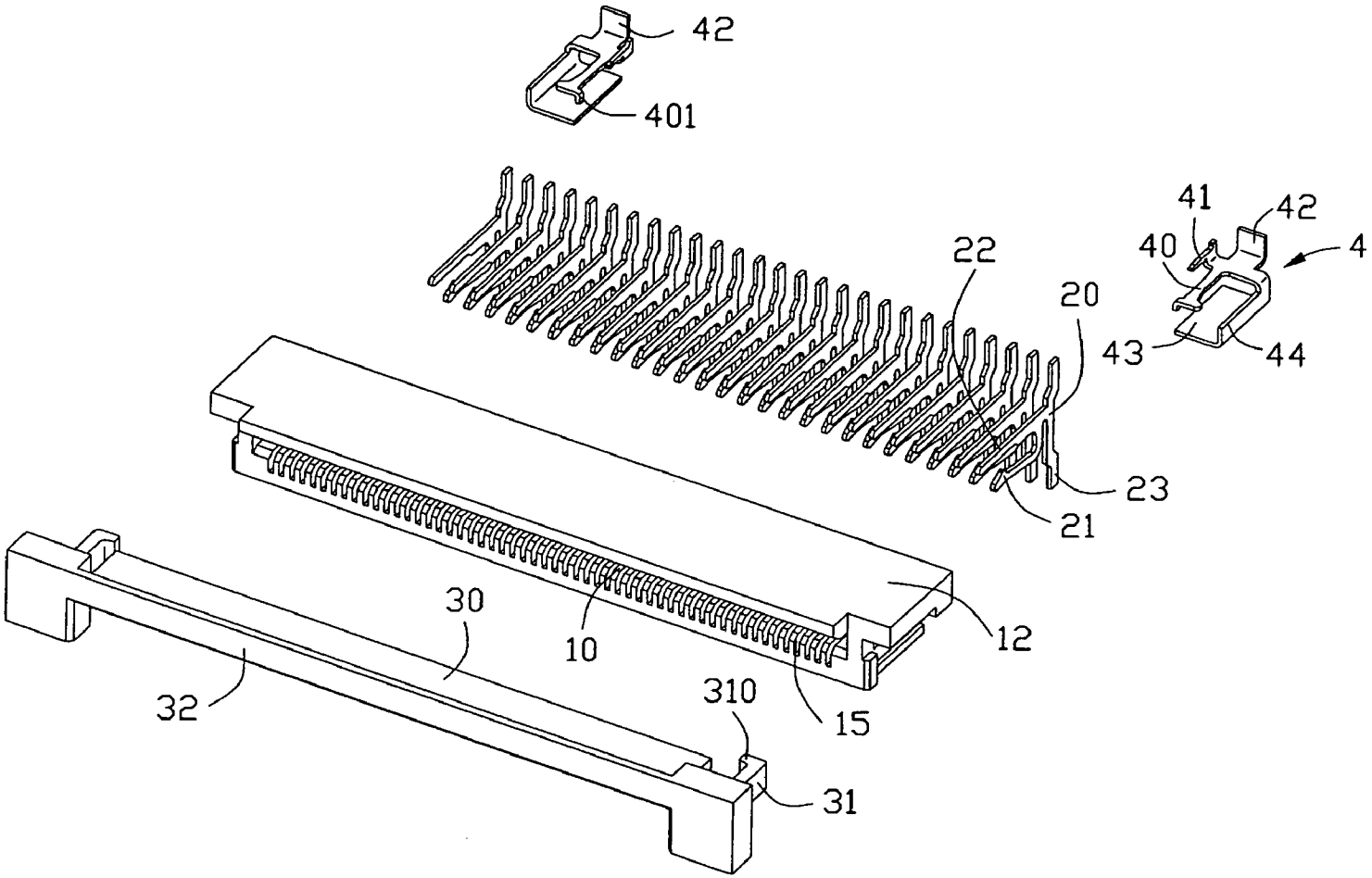
FIG. 3 is an exploded perspective view of the electrical connector.
Figure 4:
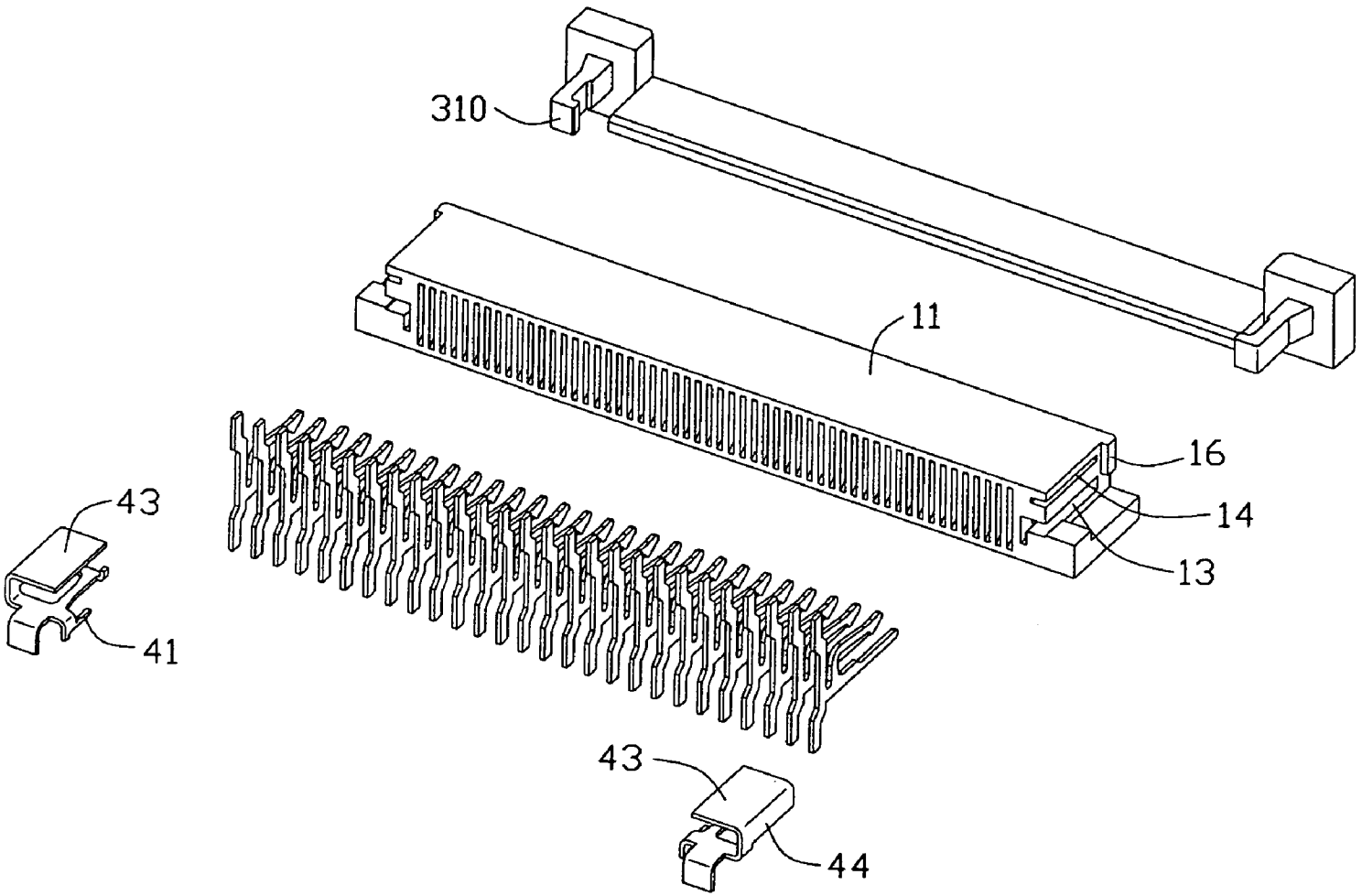
FIG. 4 is similar view of FIG. 3, but taken from another aspect.

Referring to FIGS. 3 and 4, the housing 1 is provided with a receiving cavity 10 extending along a longitudinal direction for receiving the sheet-like connection member therein. The receiving cavity 10 is surrounded by an upper wall 11, a lower wall 12 and a pair of lateral walls connecting the upper and lower walls together. The upper and lower walls 11, 12 are provided with a plurality of terminals channels 15 for retaining said terminals 2. Each lateral wall defines a L-shaped groove 13 and a slot 14 both extending from a rear surface of the housing 1 along a front-to-back direction perpendicular to the longitudinal direction, and the L-shaped groove 13 is located below the slot 14. The lateral wall further forms a blocking tuber 16 before the slot 14.

Each terminal has a base portion 20, a retention beam 22 extending substantially perpendicular to the base portion 20, a contact beam 21 branching from the retention beam 22 and extending substantially parallel to the retention beam 22 and two solder portions 23 extending outward from two ends of the base portion 20. The contact beam 21 has a contact portion projecting into the receiving cavity 10 of the housing 1.

The pressing member 3 has a tongue plate 30 for urging the sheet-like connection member 5 to electrically connect with the contact portions, a pair of latching arms 31 respectively located lateral sides of the tongue plate 30 and a base plate 32 connecting the tongue plate 30 and the pair of latching arms 31 together. Each latching arm 31 has an enlarged portion joining with the base plate 32 and a slim portion extending from the enlarged portion with a projection 310 formed a distal end thereof. The projections 310, extend oppositely toward the tongue plate 30. Moreover, both of the enlarged portion and the slim portion have inner surfaces neighboring the tongue plate 30, and the inner surface of the enlarged portion has a shorter distance relative to the tongue plate 30 in the longitudinal direction than that of the slim portion.

Referring to FIGS. 3, 4 and 7, the latching member 4 comprises a flat plate portion 43 which has an edge portion for being retained in the slot 14, a resilient arm 40 extending substantially parallel to the flat plate portion 43 and a side plate portion 44 connecting the flat plate portion 43 with the resilient arm 40. Moreover, said parts of the latching member forms a passageway for the latching arms 31 of the pressing member 3 sliding there in the front-to-back direction. The latching member 4 further comprises a retention portion 41 extending from the joining portion of the resilient arm 40 and the side plate portion 44 for frictionally engaging with the housing 1 and a solder portion 42 extending from the joining portion opposite to the resilient arm 40 for connecting a printed circuit board where the electrical connector is mounted. The retention portion 41 cooperates with the resilient arm 40 to be received in said L-shaped groove 13.

The resilient arm 40 is provided with a latching portion 401 neighboring on the receiving space 10 of the housing 1 and a bearing portion 45 neighboring on the latching arms 31 of the pressing member 3. In this embodiment, the latching portion 401 and the bearing portion 45 are both formed at a distal end of the resilient arm 40 and extending opposite to each other.

Figure 2:
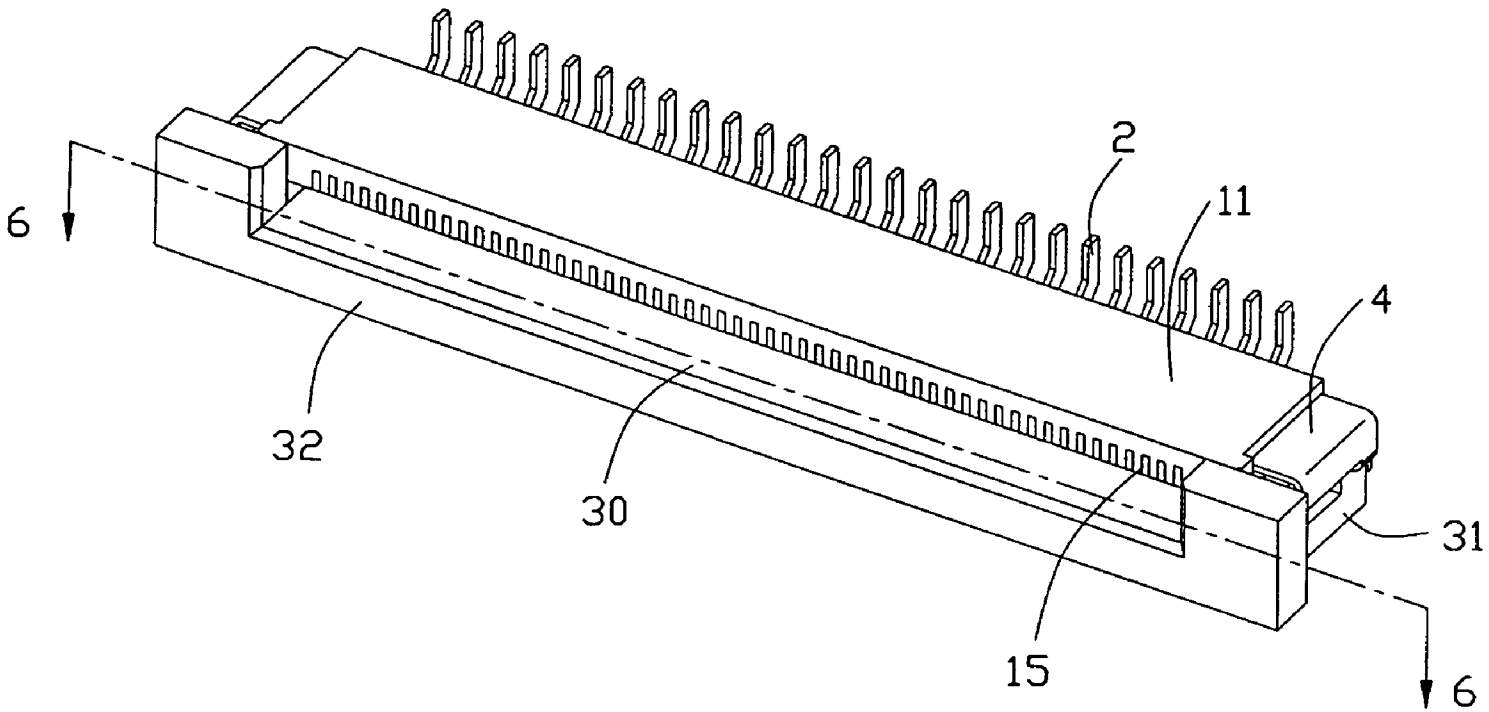
FIG. 2 is a similar view of FIG. 1, but the pressing member is in a closed position.

When assembling, the latching members 4 are respectively retained in the lateral walls from the rear end of the housing 1. The pressing member 3 is mounted to the housing 1 along a direction opposite to the latching members 4. The pressing member 3 is movable between an opened position (shown in FIG. 1) and a closed position (shown in FIG. 2) along the front-to-back direction.

Figure 5:
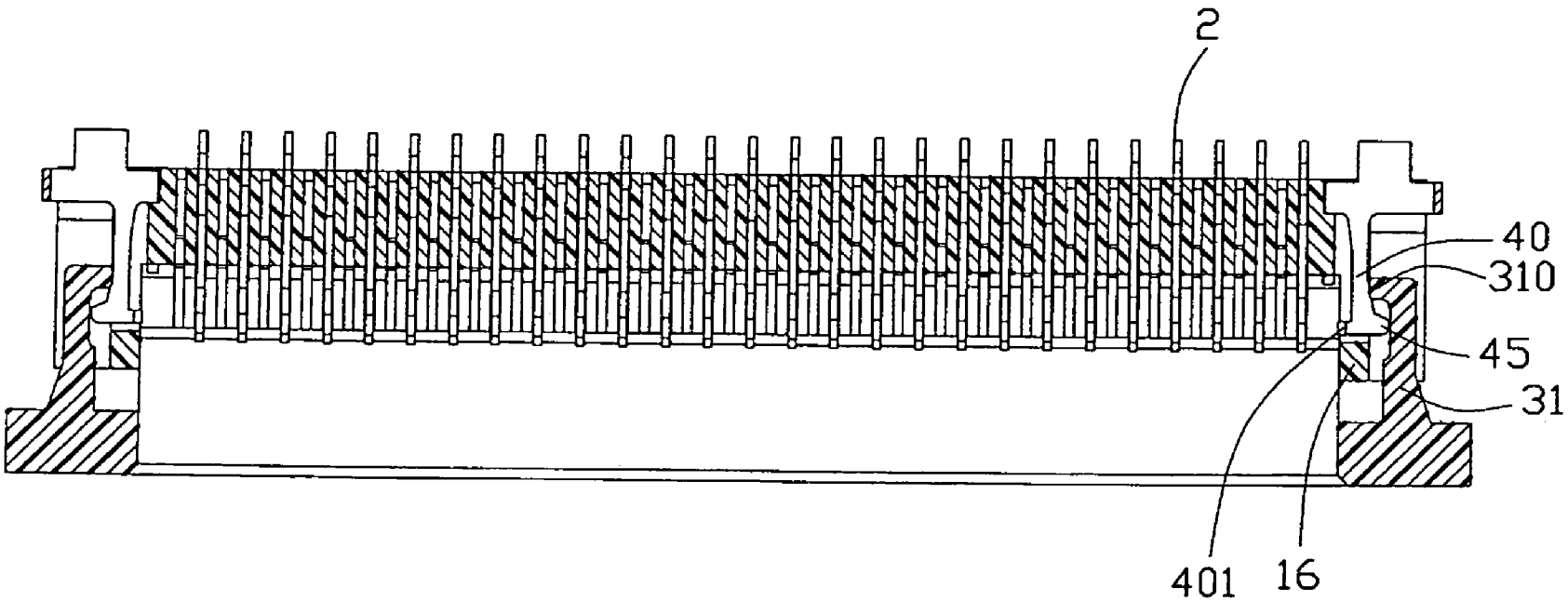
FIG. 5 is a cross-sectional view of FIG. 1 taken along line 5-5.
Figure 6:
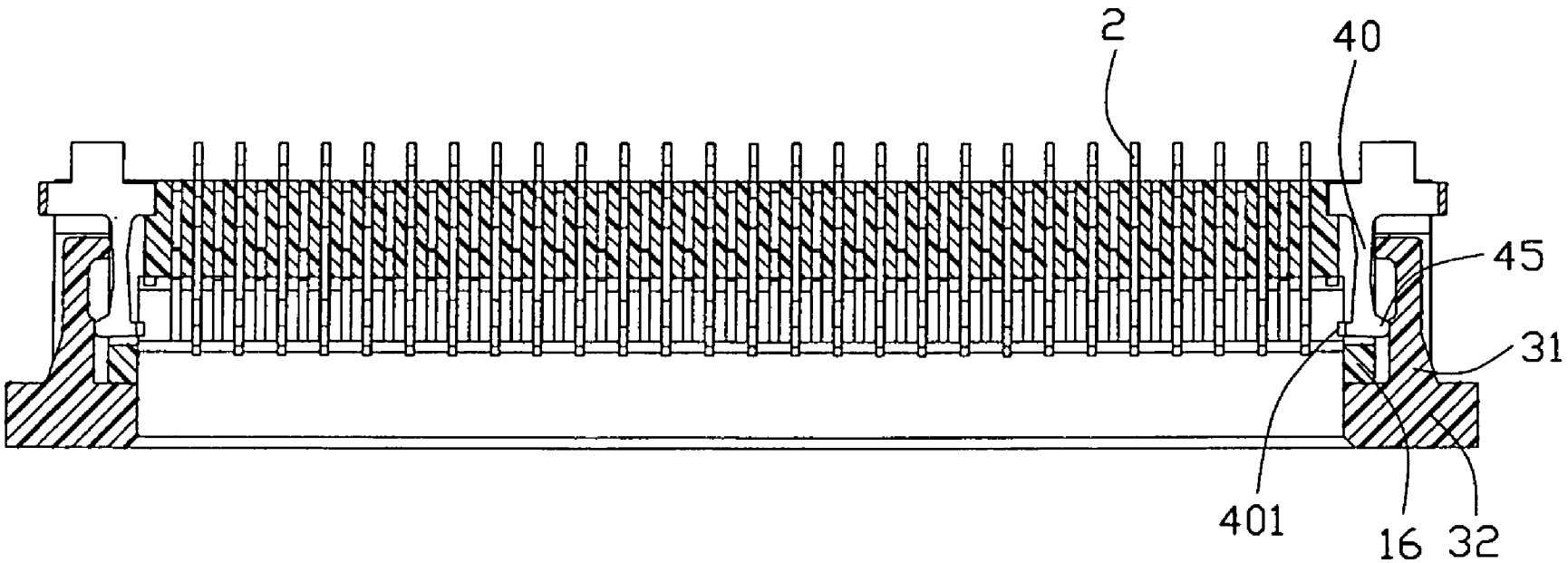
FIG. 6 is a cross-sectional view of FIG. 2 taken along line 6-6.

When the pressing member 3 is in the opened position, the latching arms 31 are located into the corresponding passageways of the latching members 4, thereby the inner surface of the slim portion directly contact with the bearing portion 45 of the latching member 4 (shown in FIG. 5). Moreover, if the bearing portions 45 are damaged, the projection 310 can instead of the bearing portions to lock with the blocking tubers 16 of the housing 1 to prevent the pressing member 3 breaking away the housing 1. After the sheet-like connection member being completely inserted into the receiving cavity 10, the pressing member 3 is pushed toward the closed portion. Further referring to FIG. 6, the resilient arm 40 contacts with the enlarged portion of the latching arm 31 unless the pressing member 3 is in the closed portion. For the inner surface of the enlarged portion has a shorter distance relative to the tongue plate 30 in the longitudinal direction than that of the slim portion, the distal end of the resilient arm 40 is resiliently distorted into the receiving cavity 10. Meanwhile, the latching portions 401 are locked with the sheet-like connection member so that the sheet-like connection member is firmly retained in the housing 1, and a stable electrical connection between the sheet-like connection member and the terminals 2 is accordingly achieved. Additionally, when the pressing member 3 arrives at the closed position, the blocking tubers 16 of the lateral walls abut against the base plate 32 for avoiding over insertion of the pressing member 3. If the sheet-like connection member is required to be removed, the pressing member is pulled back. When the bearing portions contact with the inner surfaces of slim portions of the latching arms 31, the resilient arms 40 returns to its original position by elasticity, and the latching portion 401 is disengaged from the sheet-like connection member. In this moment, the sheet-like connection member can be removed out of the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting with a sheet-like connection member, comprising:

an insulative housing defining receiving cavity;

a plurality of conductive terminals disposed in the housing and each terminal having a contact beam with a contact portion exposed to the receiving cavity;

a pressing member having a pair of latching arms formed at lengthwise ends, the pressing member associated with the housing by the latching arms and movable between an opened position where the sheet-like connection member is permitted to enter into the receiving cavity and a closed position where the pressing member urges the sheet-like connection member to electrically connect with the contact portions of the terminals; and a pair of latching members assembled on the housing and each latching member comprising a resilient arm having a latching portion, when the pressing member arrives at the closed position, the latching arms urge corresponding resilient arms to move into the receiving cavity so as to achieve an engagement between the latching portions and the sheet-like connection member.

2. The electrical connector as claimed in claim 1, wherein the latching portion extends perpendicular to the resilient arm.

3. The electrical connector as claimed in claim 2, wherein the latching portion is bent from a distal end of the resilient arm.

4. The electrical connector as claimed in claim 1, wherein the resilient arm has a bearing portion abutting against the corresponding latching arm of the pressing member.

5. The electrical connector as claimed in claim 1, wherein the latching member comprises a retention portion extending parallel to the resilient arm and frictionally engaging with the housing.

6. The electrical connector as claimed in claim 1, wherein the pressing member has a tongue plate located between the latching arms for being received in the receiving cavity of the housing.

7. The electrical connector as claimed in claim 1, wherein the latching member has a solder portion for connecting to a printed circuit board where the electrical connector is mounted.

8. The electrical connector as claimed in claim 1, wherein the latching member has a flat plate portion extending parallel to and opposite to the resilient arm and a side plate portion for joining the resilient arm with the flat plate portion, thereby a passageway for accommodating the lathing arm of the pressing member is formed by the flat plate portion, the side plate portion and the resilient arm.

9. The electrical connector as claimed in claim 1, wherein the latching arm has an enlarged portion and a slim portion extending from the enlarged portion, both of which have inner surfaces for directly contacting the resilient arm of the pressing member, and wherein the inner surface of the enlarged portion is located closer to the receiving cavity than that of the slim portion.

10. The electrical connector as claimed in claim 9, wherein when the pressing member is in the opened position, the inner surface of the slim portion contact with the resilient arm, but when the pressing member is in the closed position, the inner surface of the enlarged portion is shifted to contact with the resilient arm, and further have the latching portion latch on the sheet-like connection member.

11. An electrical connector comprising:

an insulative housing defining a mating cavity extending rearward from a front face thereof;

a plurality of contacts disposed in the housing and extending into the mating cavity;

a pressing member moveably assembled to the housing between open and closed positions, said pressing member including a pair of latching arms at two opposite ends; and a pair of latching members located at two opposite ends of the housing, each of said latching members defining resilient arm with a locking lug thereon wherein when the pressing member is in the closed position, the resilient arm is located at a first position latching the lug into a notch of a flexible printed circuit board; when the pressing member is in an open position, the resilient arm is located at a second position unlatching the lug from the notch of the flexible printed circuit board.

* * * * *